United States Patent [19]

Cook et al.

[11] 4,387,018

[45] Jun. 7, 1983

[54] METHOD OF REMOVING POLYCHLORINATED BIPHENYL FROM OIL

[75] Inventors: Gus T. Cook, Paducah; Stephen K. Holshouser, Boaz; Richard M. Coleman, Paducah; Charles E. Harless, Smithland; Walter N. Whinnery, III, Paducah, all of Ky.

[73] Assignee: The United States of America as represented by the United States Department of Energy, Washington, D.C.

[21] Appl. No.: 358,959

[22] Filed: Mar. 17, 1982

[51] Int. Cl.[3] ..... C10G 21/16

[52] U.S. Cl. ..... 208/262; 570/211

[58] Field of Search ..... 208/262, 180, 333; 210/909; 585/864; 570/211

[56] References Cited

U.S. PATENT DOCUMENTS

| | | | |
|---|---|---|---|
| 3,400,171 | 9/1968 | Van Pool | 208/262 |
| 3,833,674 | 9/1974 | Brackenridge | 570/211 |
| 3,985,644 | 10/1976 | Eberly, Jr. | 208/321 |
| 4,073,720 | 2/1978 | Whisman et al. | 208/180 |
| 4,124,492 | 11/1978 | Fung et al. | 208/180 |
| 4,144,152 | 3/1979 | Kitchens | 204/158 R |
| 4,299,704 | 11/1981 | Foss | 210/634 |

FOREIGN PATENT DOCUMENTS

| | | | |
|---|---|---|---|
| 1517685 | 4/1972 | Fed. Rep. of Germany | 210/909 |

*Primary Examiner*—Delbert E. Gantz
*Assistant Examiner*—O. Chaudhuri
*Attorney, Agent, or Firm*—Edwin D. Grant; Stephen D. Hamel; Richard G. Besha

[57] ABSTRACT

Polychlorinated biphenyls are removed from oil by extracting the biphenyls into methanol. The mixture of methanol and extracted biphenyls is distilled to separate methanol therefrom, and the methanol is recycled for further use in extraction of biphenyls from oil.

6 Claims, 4 Drawing Figures

METHOD OF REMOVING POLYCHLORINATED BIPHENYL FROM OIL

This invention, which resulted from a contract with the United States Department of Energy, relates to a method for separating polychlorinated biphenyl compounds from petroleum products such as lubrication oil or transformer oil.

BACKGROUND OF THE INVENTION

Polychlorinated biphenyls (hereinafter referred to as PCBs for brevity) have been used in many applications for more than forty years. PCB-filled transformers have found wide use because PCB does not burn or sustain fire under conditions of internal arcing. PCB-filled power and industrial capacitors are significantly smaller, more reliable, more durable, and safer than oil-filled capacitors. In short, PCBs are ideal fluids for electrical equipment and heat-transfer systems because of their heat stability, nonflammable nature, low volatility and good viscosity characteristics at operating temperatures.

However, evidence has recently been presented which shows that PCBs are widely dispersed in the environment and have the potential to damage both the environment and people. Studies have shown that adverse health effects such as liver damage and chloracne may result from inhalation or skin absorption of certain types of PCB compounds. Also, PCBs have recently been classified as suspect teratogens, which means that fertile females should avoid exposure to these compounds.

The manufacture of PCBs has currently been discontinued and Environmental Protection Agency regulations have been issued under the authority of the Toxic Substances Control Act to control the materials now in use in the United States. These regulations, which became effective July 1, 1980, define any material containing 50 ppm or more of a mono- or polychlorinated biphenyl as a PCB and regulate its use and disposition. Currently, the only permissible disposal of a PCB is by incineration in an EPA-approved incinerator (none exist) or by burial in an EPA-approved landfill.

Either disposal method requires transportation from the point of use to the disposal site, thereby increasing the chances of inadvertent release into the environment. Furthermore, the siting of incinerators to burn PCBs has met strong opposition from local residents of areas under consideration. Consequently, an economical process which facilitates disposal of oil contaminated with PCBs is a most sought-after solution.

At the Paducah Gaseous Diffusion Plant, operated by Union Carbide Corporation for the U.S. Department of Energy, a large lubrication oil system was found to be contaminated with 67 $\mu$g of Arochlor 1254 (a Monsanto Chemical Corporation formulation) per gram of oil. Since this level of contamination was above the 50 $\mu$g/g PCB level set by EPA and since serious operational problems as well as significant economic losses would be sustained if the contaminated units were to be taken off stream, several methods were attempted to effect the removal of these PCBs.

Fuller's earth, normally used to remove oxidation products from lubrication oil, reduced the PCB content by approximately 20 percent after slurrying a 10 percent volume of this material with the oil for 18 hours. Similar tests and results were obtained with activated charcoal.

Although these tests resulted in a reduction of the PCB content of the oil, it was not a satisfactory solution since significant disposal problems were encountered with the use of adsorbents.

An evaluation was also made of the use of organosodium compounds such as sodium biphenyl and sodium napthalene for PCB removal. It was necessary to use a quantity of these compounds greatly in excess of the theoretical amount required to reduce the PCB to an acceptable level. Both the material cost and the potential alteration of lube oil quality precluded the use of this method. In addition, experiments were carried out using combinations of adsorbents along with organosodium compounds to effectuate PCB removal with fair results. However, none of these efforts approached the effectiveness of the subject invention.

SUMMARY OF THE INVENTION

It is therefore an object of this invention to provide an effective process for removing a polychlorinated biphenyl from a petroleum product such as lubrication oil or transformer oil.

This object is achieved, in accordance with the preferred method of the invention, by continuously contacting methanol with a liquid petroleum product containing one or more polychlorinated biphenyls to thereby extract the polychlorinated biphenyl compound or compounds into the methanol, distilling methanol from the mixture of methanol and the polychlorinated biphenyl compound or compounds extracted therein, and recycling the distilled methanol into contact with the petroleum product.

DETAILED DESCRIPTION OF THE INVENTION

The distribution coefficient K applicable to this invention is shown in the following equation:

$$K = \frac{X\,V_{oil}}{(1 - X)\,V_{CH4OH}} = \text{approx. } 0.154 \text{ at } 23^\circ \text{ C.}$$

where $V_{oil}$=volume of PCBs in lube oil at equilibrium $V_{CH4OH}$=volume of methanol X=fractional reduction on PCB content in lube oil at equilibrium.

Commercial formulations of PCBs such as Arochlor 1260, 1254, 1248, 1242 etc. are complicated mixtures of chlorobiphenyls with different numbers of chlorine atoms per molecule and their isomers. Indeed there are theoretically 209 different chlorobiphenyls. While no formulation likely contains all of the different possibilities, they are nonetheless extremely complex and contain a large number of the different chlorobiphenyls.

As seen in Table I, the different formulations generally differ in the relative quantities of a particular chlorbiphenyl with many of the compounds being common to all Arochlor formulations. For example, with regard to pentachlorobiphenyl, Arochlor 1242 contains 22%, Arochlor 1254 49%, and Arochlor 1260 about 12%. The same is generally true for other chlorobiphenyls in the various formulations but the percent composition may vary to a lesser or greater degree. The point is that most commercial formulations have the same chlorobiphenyls but the relative amounts may differ. Thus any process which removes Arochlor 1260 would be expected to remove Arochlors 1242 and 1254 since the same chemical compounds are present in the formulations.

TABLE I

Molecular Composition of Some Arochlors

| Chlorobiphenyl Composition | Percent in Arochlor 1242 | 1254 | 1260 |
|---|---|---|---|
| $C_{12}H_9Cl$ | 3 | — | — |
| $C_{12}H_8Cl_2$ | 13 | — | — |
| $C_{12}H_7Cl_3$ | 28 | — | — |
| $C_{12}H_6Cl_4$ | 30 | 11 | — |
| $C_{12}H_5Cl_5$ | 22 | 49 | 12 |
| $C_{12}H_4Cl_6$ | 4 | 34 | 38 |
| $C_{12}H_3Cl_7$ | — | 6 | 41 |
| $C_{12}H_2Cl_8$ | — | — | 8 |
| $C_{12}HCl_9$ | — | — | 1 |

Figure 1:
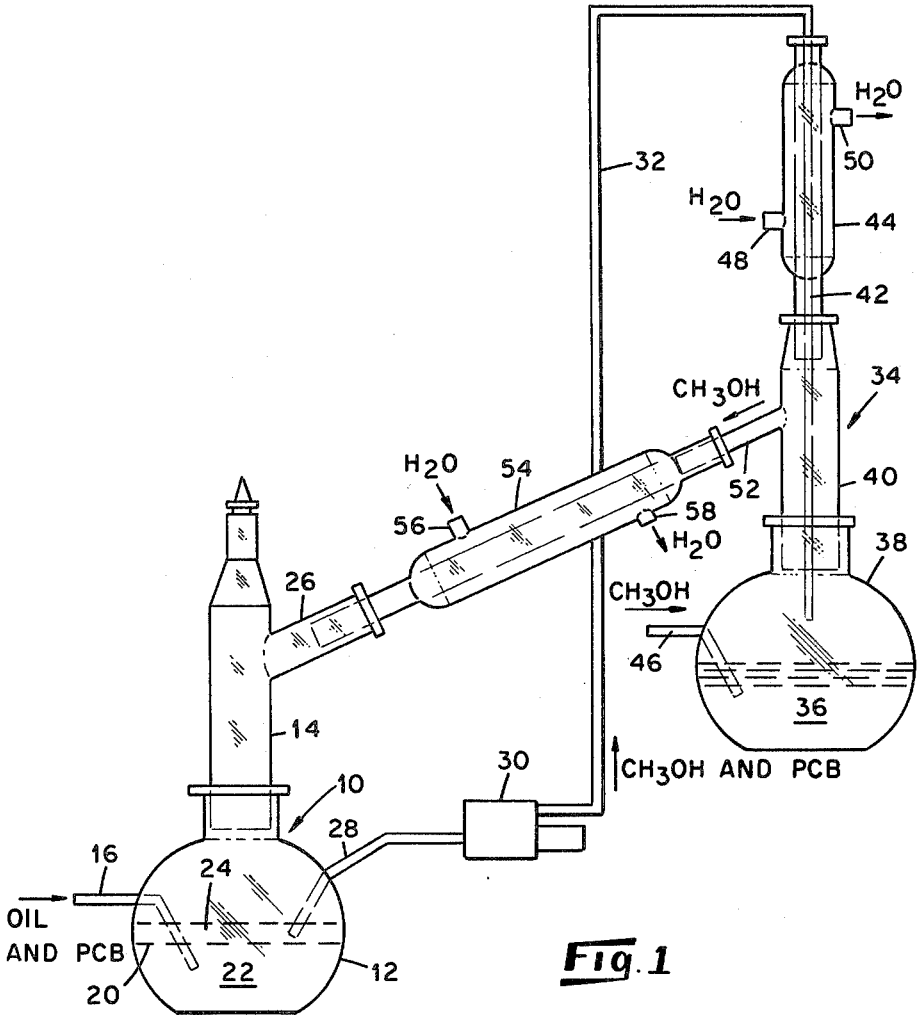
FIG. 1 is a schematic representation of an apparatus used to demonstrate the steps of the invention.

Since PCBs are much more soluble in lube oil than in methanol, effective removal of the PCBs from the oil cannot be achieved by a single extraction step. However, the extraction of PCBs from lube oil can be efficiently performed in a batch process by the apparatus schematically represented in FIG. 1, wherein reference number 10 generally designates an extraction vessel having an oil reservoir 12 and a columnar upper portion 14. Contaminated lube oil is charged into the extraction vessel through a conduit 16 the outlet end of which is below the interface 20 between lube oil 22 and methanol 24 in the vessel. Preferably the oil is continuously and gently stirred by a suitable means such as a rotating paddle (not illustrated) whereby the exchange at the liquid-liquid interface is accelerated and which thereby reduces the time required for PCB removal. Oil reservoir 12 is maintained at a temperature in the range of 20°-40° C. For a purpose disclosed hereinafter, an inlet 26 is secured to the upper portion of vessel 10. A conduit 28 extends through the wall of the lower portion of the extraction vessel 10 and terminates at a point located within methanol stratum 24. A pump 30 is connected to the outer end of conduit 28 and to another conduit 32 which enters the upper end of a distillation column generally designated by reference number 34 and which terminates above the body of liquid 36 therein. Column 34 has a reservoir 38 for holding the aforesaid liquid 36 and includes an intermediate columnar portion 40 and an upper columnar reflux portion 42 which has a heat exchanger jacket 44 concentrically disposed around most of the strength thereof. Cooling fluid for heat exchanger jacket 44 enters the annulus between upper reflex portion 42 and jacket 44 at inlet 48 and is withdrawn through an outlet 50. Cooling fluid is also respectively supplied to and withdrawn from the annulus between conduit 52 and heat exchanger jacket 54 through inlet 56 and outlet 58 connected to jacket 54. Methanol is charged to distillation reservoir 38 through a conduit 46 the outlet end of which is submerged in liquid 36. An oil to methanol ratio of 15:1 and a distillation rate equivalent to 8 percent of the original methanol charge per minute were used.

Figure 4:
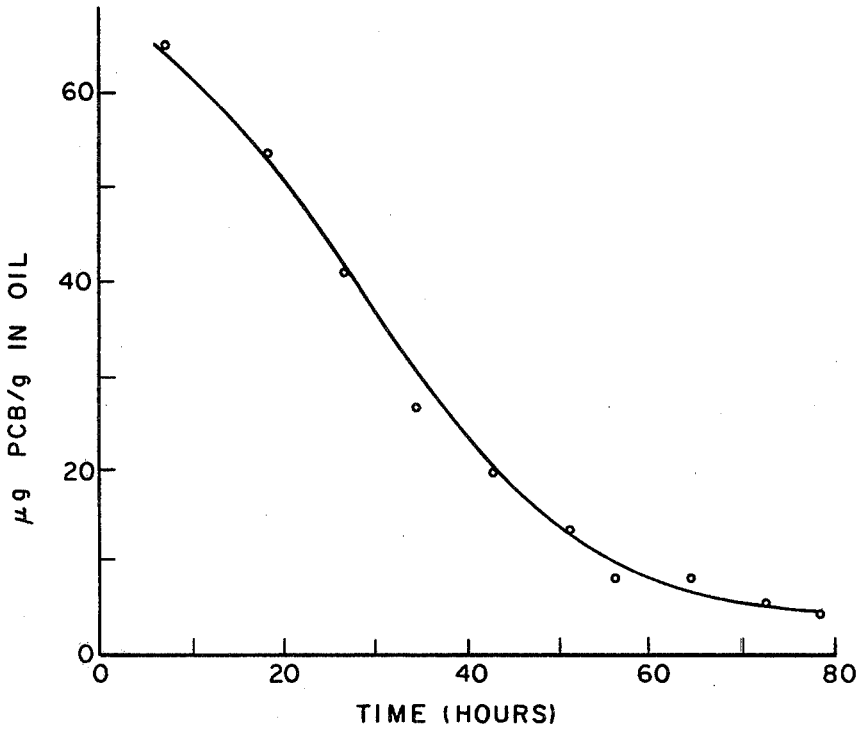
FIG. 4 is a graph showing the rate of removal of polychlorinated biphenyl from the lubrication oil according to the method of the invention.

In one test example of the method of the invention, lubrication oil contaminated with about 67$\mu$ gram of Arochlor 1254 per gram of oil was charged to extraction vessel 10 through conduit 16 while methanol was being continuously fed to reservoir 12 through conduit 52. Distillation column 24 was operated at a temperature of 65° C. in reservoir 38 and with the reflux portion 44 of the column cooled by passing water at a temperature of approximately 13° C. through inlet 48 into heat exchanger jacket 44. The methanol-rich distillate condensed within conduit 52 by heat exchanger jacket 54 was collected above contaminated oil 22 in reservoir 12 of extraction vessel 10. In the preferred embodiment, the oil was maintained at a temperature of about 30° C. and gently stirred to accelerate transfer of PCBs into the methanol stratum 24. Methanol containing PCBs was pumped through conduit 32 to reservoir 38 of distillation column 34 and methanol in the PCB-methanol mixture was continuously evaporated in the reservoir at a distillation rate of 8% of the original methanol charge per minute. FIG. 4 shows that after the described apparatus had been operated for about 60 hours, the concentration of PCBs in the oil in reservoir 12 had been reduced to less than 10$\mu$ gram per gram of oil. After 80 hours of operation, the PCB concentration of the oil in reservoir 12 was reduced to about 5$\mu$ gram per gram of oil.

In a second test of the efficacy of the process of this invention, the feasibility of replacing extraction vessel 10 in the process of the invention with a packed extraction column operated with counter-current flow was determined. The packed column had a length of 2 feet, a uniform internal diameter of 1 inch, and a packing of $\frac{1}{8}$-inch diameter glass beads along its entire length. With the packed column operated at a temperature of 23° C. and filled with 100 ml of electrical oil contaminated with 667 ppm of Arochlor 1260, methanol was charged into the lower end of the column at a rate of 85 ml/min. After 1.3 hours of operation a 75% reduction in the PCB content of the oil in reservoir 12 was noted, which amply demonstrated the practicality of using a counter-current flow packed column in the extraction step of the process.

Figure 2:
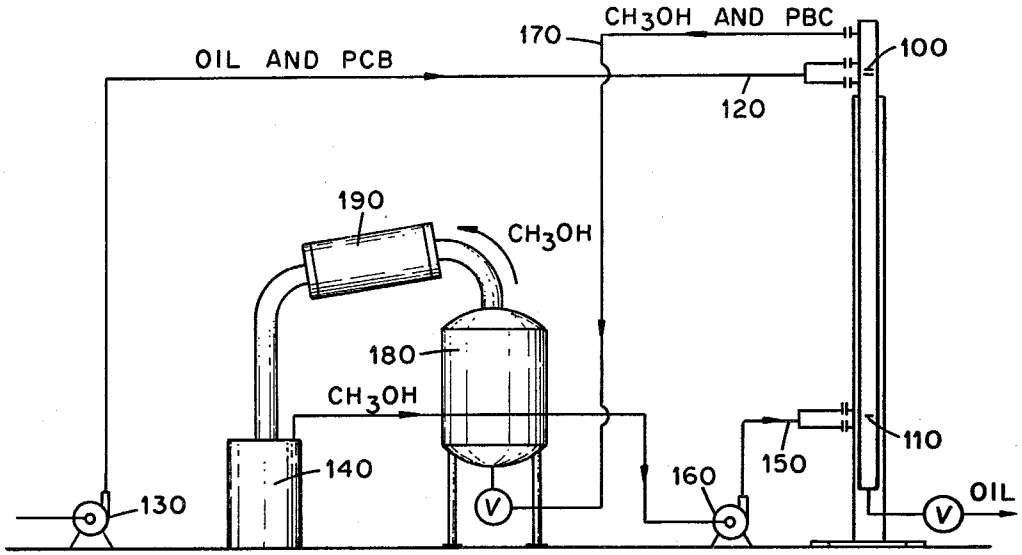
FIG. 2 is a flow diagram showing the manner in which the invention is continuously operated in an industrial setting.
Figure 3:
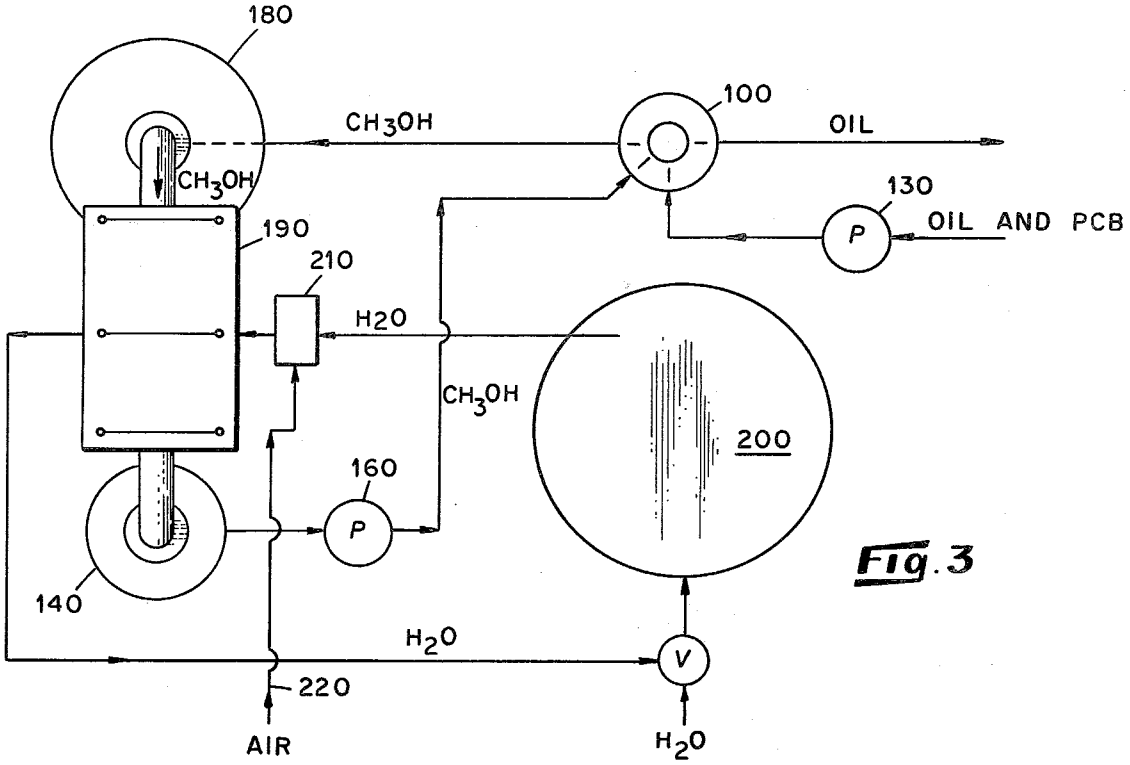
FIG. 3 is a schematic plan view of the apparatus of FIG. 2 showing the manner in which cooling water is supplied to the condenser unit of the invention.

By referring to the flow diagrams of FIG. 2 and FIG. 3 which show the manner in which the subject invention is scaled to operate in an industrial environment, it can be seen that extraction of PCBs takes place in an extraction vessel 100 which comprises an elongated columnar structure having a multiplicity of ring diffusers 110 therein. Contaminated lube oil is continuously charged to the top of vessel 100 at conduit 120 by means of oil pump 130 while clean methanol is continuously charged from methanol tank 140 to the bottom of vessel 100 through conduit 150 by means of methanol pump 160. Extraction column 100 is operated at ambient temperatures and methanol containing extracted PCBs is removed from extraction column 100 at outlet 170 and enters methanol still 180. Purified methanol from methanol still 180 is condensed by means of condenser 190 into methanol tank 140. As seen in FIG. 3, a cooling water tank 200 supplies water to condenser 190 through pump 210 which is operated by means of compressed air which enters at line 220. For simplicity, tank 200 is not illustrated in FIG. 2.

In addition to the original demonstration of the feasibility of the concept in which a 68 percent reduction in PCB content (of Arochlor 1254) was shown after the seventh stage in a seven stage methanol extraction of a single oil sample, similar tests were made using isopropyl alcohol and ethyl alcohol. Reductions of 90 percent and 88 percent were noted after the seventh stage for isopropyl and ethyl alcohol, respectively. While these higher reductions are suggestive that these alcohols might be a better choice for PCB removal, the much higher solubility of oil therein presents operational scaling problems.

It will be recognized from a consideration of the data presented hereinabove that the process of the invention can be used to remove a high percentage of PCB contamination from a liquid petroleum product, thereby permitting convenient separate disposal of the concentrated PCB product and reuse of the purified petroleum product. The process of the invention utilizes a single process liquid, which forms no toxic compounds with PCBs and which is economically reused in the process.

What is claimed is:

1. A method of removing a polychlorinated biphenyl from a liquid petroleum product containing the same, comprising:

contacting the petroleum product with an alcohol selected from the group consisting of methanol, ethanol, and isopropyl alcohol to extract the polychlorinated biphenyl from the petroleum product into the alcohol;

distilling alcohol from the mixture of alcohol and polychlorinated biphenyl extracted therein; and recycling the distilled alcohol into contact with the petroleum product.

2. The method of claim 1 wherein said alcohol is methanol.

3. The method of claim 2 wherein methanol is contacted with the petroleum product at a temperature in the range of 20°–40° C. and wherein methanol is distilled from the mixture of methanol and polychlorinated biphenyl extracted therein at the boiling temperature of methanol.

4. The method of claim 2 wherein methanol is contacted with the petroleum product in a packed column.

5. The method of claim 1 wherein the petroleum product is lubricating oil.

6. The method of claim 1 wherein the petroleum product is transformer electrical oil.

* * * * *